US008628143B2

(12) United States Patent
Wald

(10) Patent No.: US 8,628,143 B2
(45) Date of Patent: Jan. 14, 2014

(54) CORNER-BRACED, PORTABLE, FOOT PROP

(76) Inventor: Kristin Wald, Chicago, IL (US)

( * ) Notice: Subject to any disclaimer, the term of this patent is extended or adjusted under 35 U.S.C. 154(b) by 144 days.

(21) Appl. No.: 12/856,635

(22) Filed: Aug. 14, 2010

(65) Prior Publication Data

US 2011/0113990 A1 May 19, 2011

Related U.S. Application Data

(60) Provisional application No. 61/261,792, filed on Nov. 17, 2009.

(51) Int. Cl.
*A47C 20/02* (2006.01)

(52) U.S. Cl.
USPC ..... 297/423.39; 297/195.1; 297/423.14; 108/42

(58) Field of Classification Search
USPC ..... 297/338, 423.39, 423.41, 423.42, 297/423.43, 423.44, 423.45, 423.46, 195.1, 297/423.14; 108/42, 50.12, 149, 150; 248/200.1, 220.1, 351
See application file for complete search history.

(56) References Cited

U.S. PATENT DOCUMENTS

| | | | | |
|---|---|---|---|---|
| 2,634,795 | A | 3/1950 | Bishop | |
| 2,567,595 | A * | 9/1951 | Bryant | 108/116 |
| 2,818,577 | A | 1/1958 | Kubik et al. | |
| 3,161,435 | A | 12/1964 | Halverson | |
| 4,270,463 | A * | 6/1981 | Korzon | 108/96 |
| 4,930,839 | A * | 6/1990 | Saito et al. | 297/338 |
| 5,188,424 | A * | 2/1993 | Herron | 297/195.1 |
| 5,579,545 | A | 12/1996 | Beard | |
| 5,647,072 | A * | 7/1997 | Shaffer et al. | 4/574.1 |
| 6,848,368 | B2 * | 2/2005 | Leith | 108/42 |
| 2006/0143820 | A1 * | 7/2006 | Matthews | 4/611 |
| 2009/0277068 | A1 | 11/2009 | Lamar | |

FOREIGN PATENT DOCUMENTS

| | | |
|---|---|---|
| GB | 2210784 | 6/1989 |

* cited by examiner

*Primary Examiner* — David R Dunn
*Assistant Examiner* — Timothy J Brindley
(74) *Attorney, Agent, or Firm* — David J. Bremer

(57) ABSTRACT

A corner-braced foot prop including a shelf and an angled support post resting on a base surface to support a load in an elevated position. The shelf includes a clearance hole through which the post is positioned and gripped by the clearance hole when the shelf rotates with respect to the post. The foot prop utilizes surrounding walls for lateral support while providing increasing stability when loaded by downward force.

11 Claims, 7 Drawing Sheets

CORNER-BRACED, PORTABLE, FOOT PROP

The invention is a foot prop for assisting a user in positioning a foot in an elevated location, for example when washing the foot, tying a shoe, shaving a leg, and various other purposes. The foot prop can be utilized to rest the foot, leg, and other items while holding the foot, leg, and other items at a height spaced apart from a base surface such as a floor. The prop can contact surrounding surfaces, such as walls, to provide stability. The unique configuration of the foot prop can enable the prop to stabilize with the application of downward force, for example the downward force of the foot pressing on the foot prop.

The foot prop is lightweight and requires no hooks, adhesives or other anchors to provide stable, controlled-height support. The prop can be easily disassembled for storage and travel.

DRAWINGS

DETAILED DESCRIPTION

The foot prop can have a shelf and a post, where the post supports the shelf spaced apart from the base surface. In use, the shelf can be wedged into a corner between two walls so that the walls limit prop movement towards the walls. Furthermore, in use the shelf can transmit downward force through the post to the base surface, and the unique configuration of the foot prop can provide increased stability against tipping when downward force is applied to the shelf.

In an embodiment shown in FIGS. 1-7, the foot prop 10 can be positioned in a corner proximal an intersection 83 of two substantially vertical walls 82. The intersection 83 can be a virtual intersection, such as when the vertical walls 82 are non-parallel but not in contact. The vertical walls can define a vertical post plane 314 (shown in FIG. 2) where the post plane 314 is medial to the vertical walls 82 and where the post plane 314 coincides with the intersection 83.

The foot prop 10 can contact each of the vertical walls so that the walls limit prop movement towards the walls.

Figure 1:
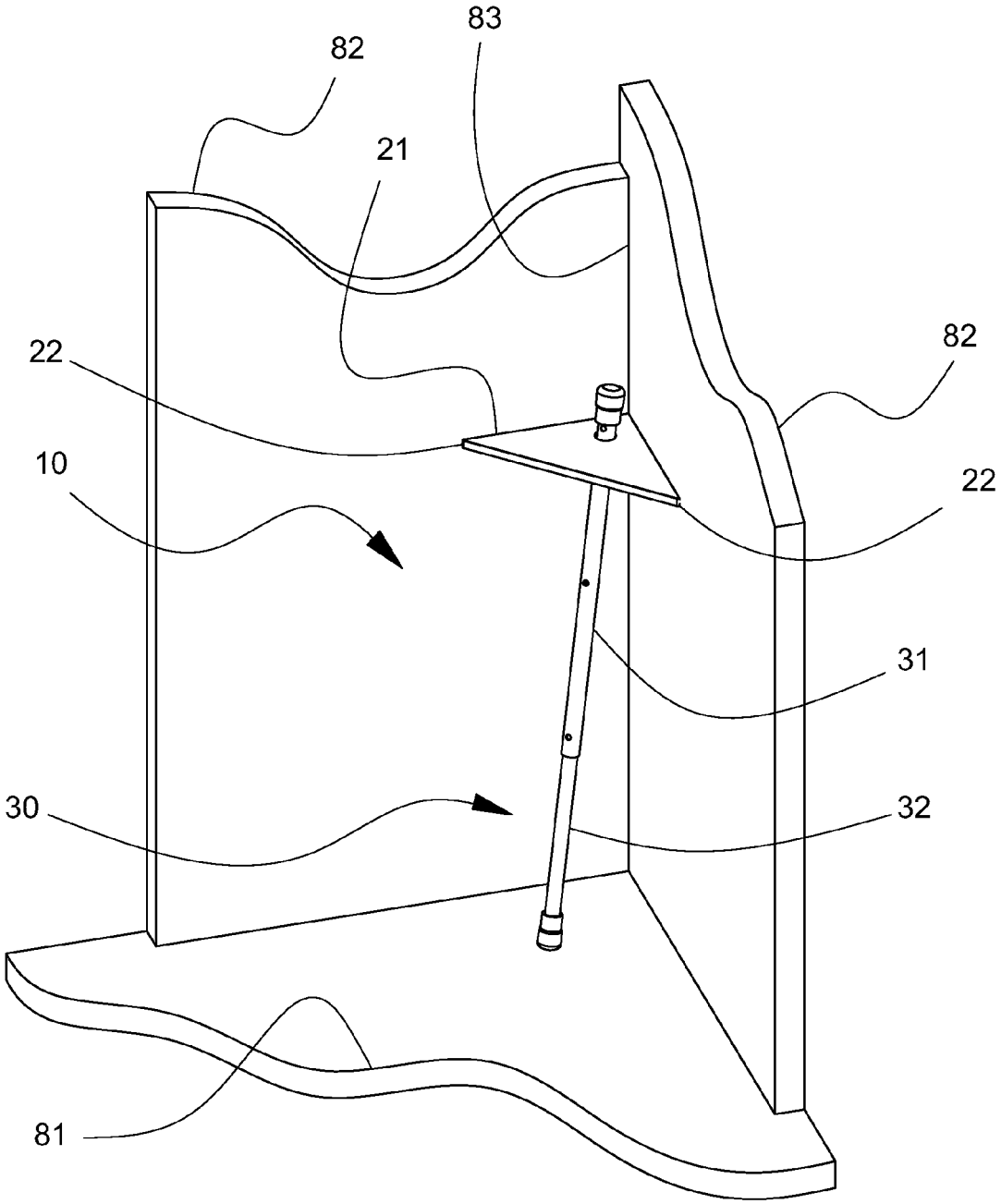
FIG. 1 shows an embodiment of the foot prop positioned in a corner.
Figure 2:
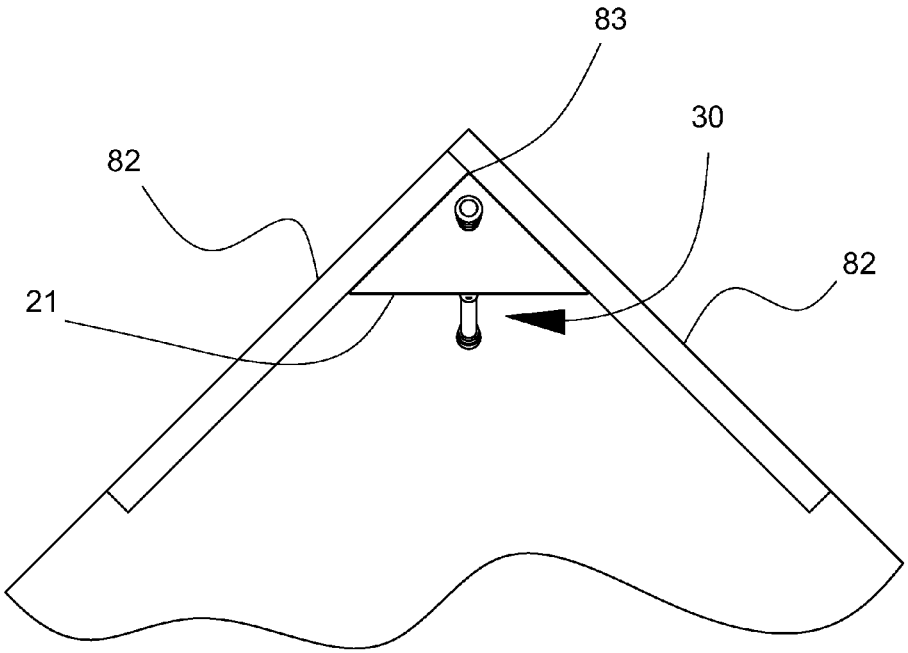
FIG. 2 shows a top view of the embodiment in a corner.
Figure 3:
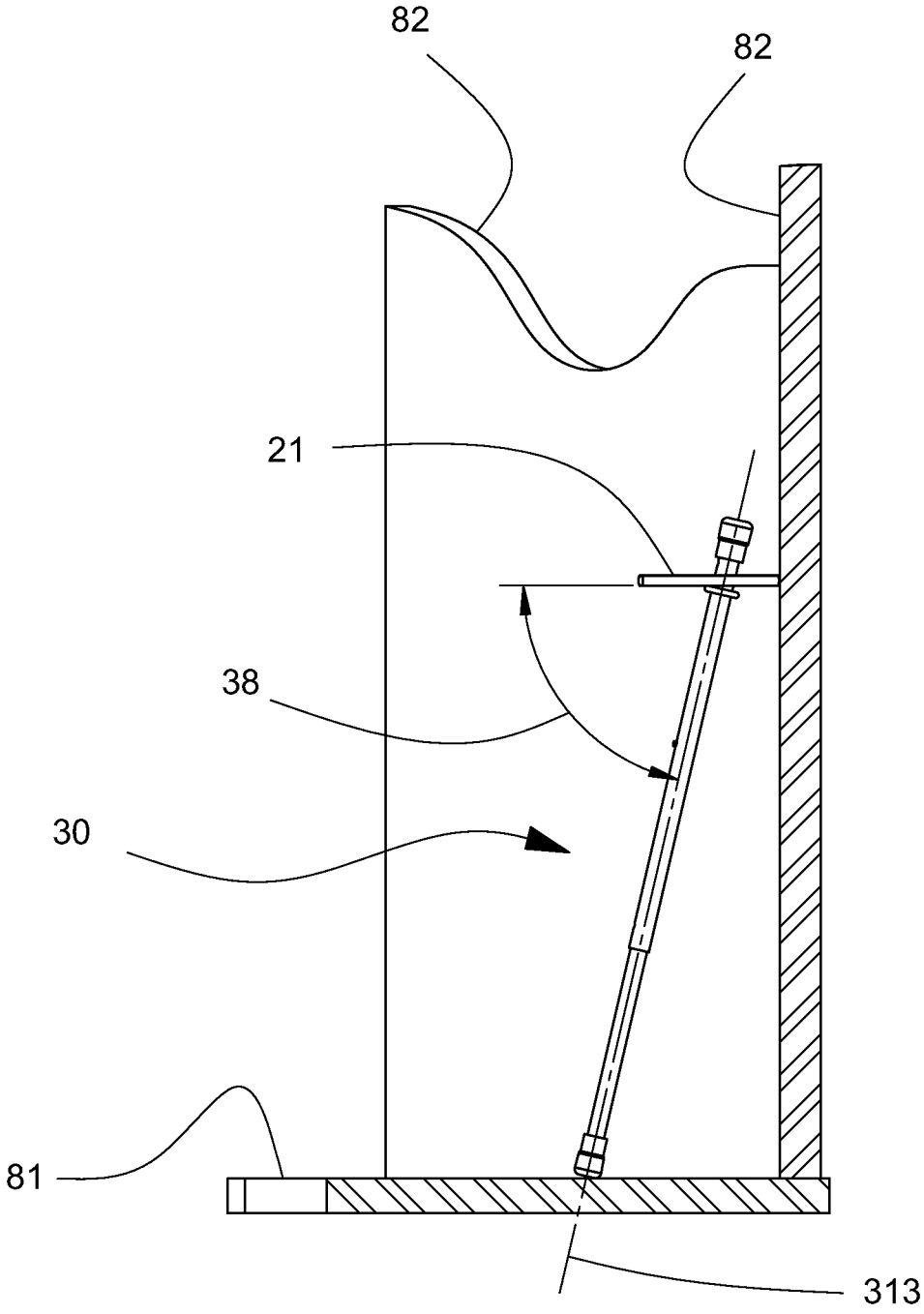
FIG. 3 shows a side view of the embodiment of the foot prop.

As shown in FIG. 3, the foot prop 10 can comprise a shelf 21 and a post 30. The shelf 21 can support a foot 91 and can support tools, washing accessories, and various items. The post 30 can extend from the shelf 21 downwards and can rest on a base surface, for example on a floor 81 and on various substantially horizontal support surfaces. The post 30 can be operatively connected to the shelf 21 so that the post supports the shelf in spaced-apart orientation from the floor 81.

Figure 4:
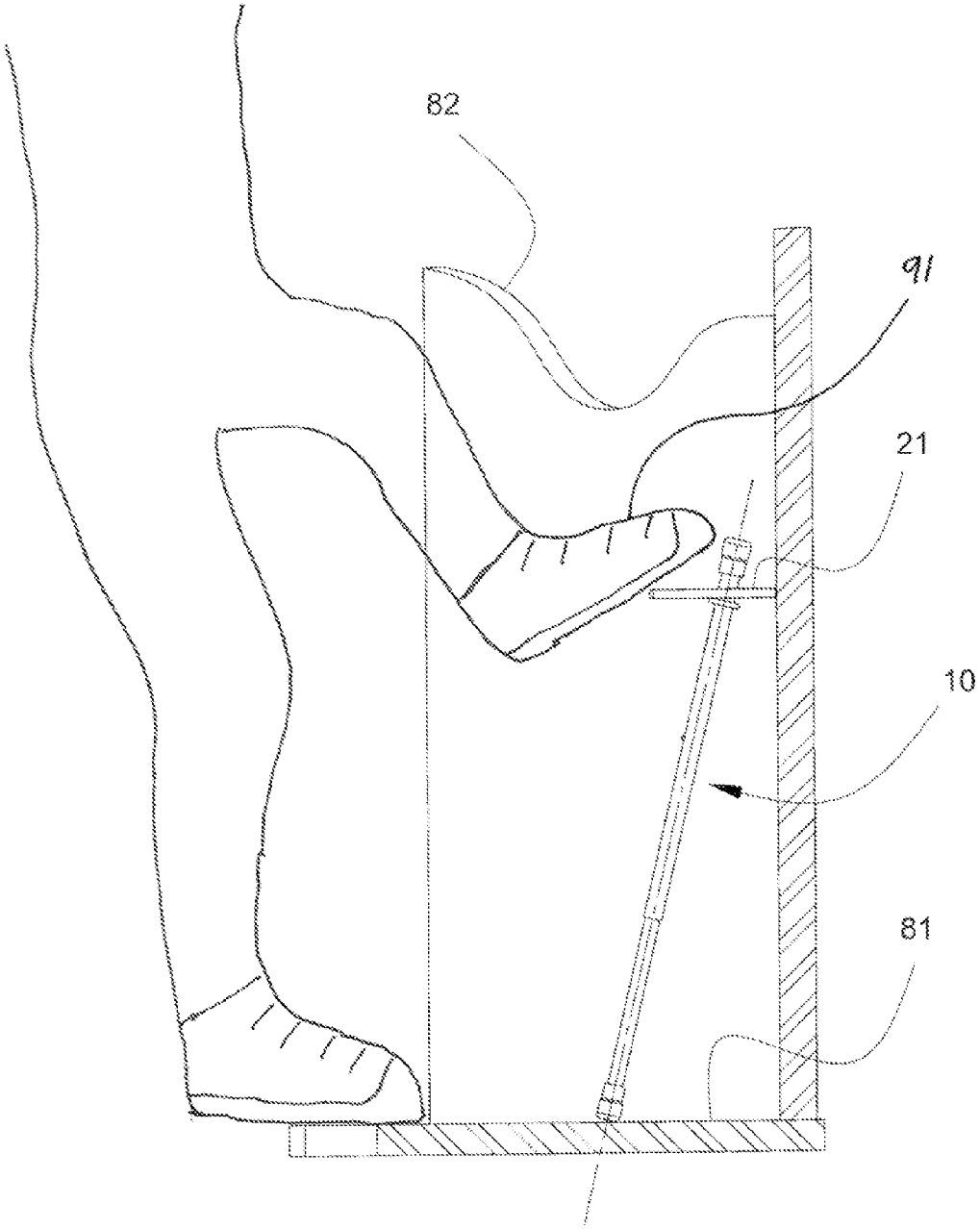
FIG. 4 shows a user positioning a foot on the embodiment.

FIG. 4 is a side view showing the foot prop 10 in use supporting a foot 91. As the foot 91 rests on the foot prop 10, the shelf 21 can be pressed against the walls 82 and pushed downwards towards the base 81. In use, the configuration of the shelf 21 and the post 30 can cause the shelf 21 to wedge against the walls 82, with the walls 82 limiting shelf motion towards the walls and the post 30 limiting shelf motion towards the floor 81.

Figure 5:
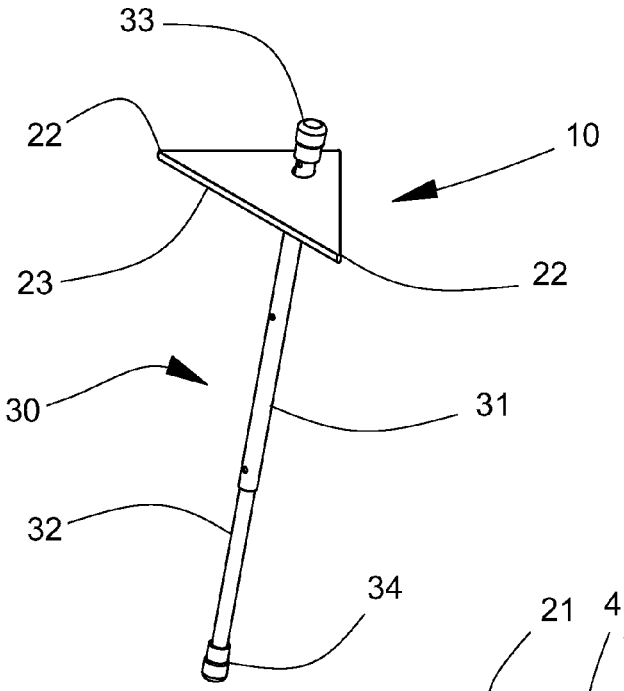
FIG. 5 is a perspective view of the embodiment.
Figure 6:
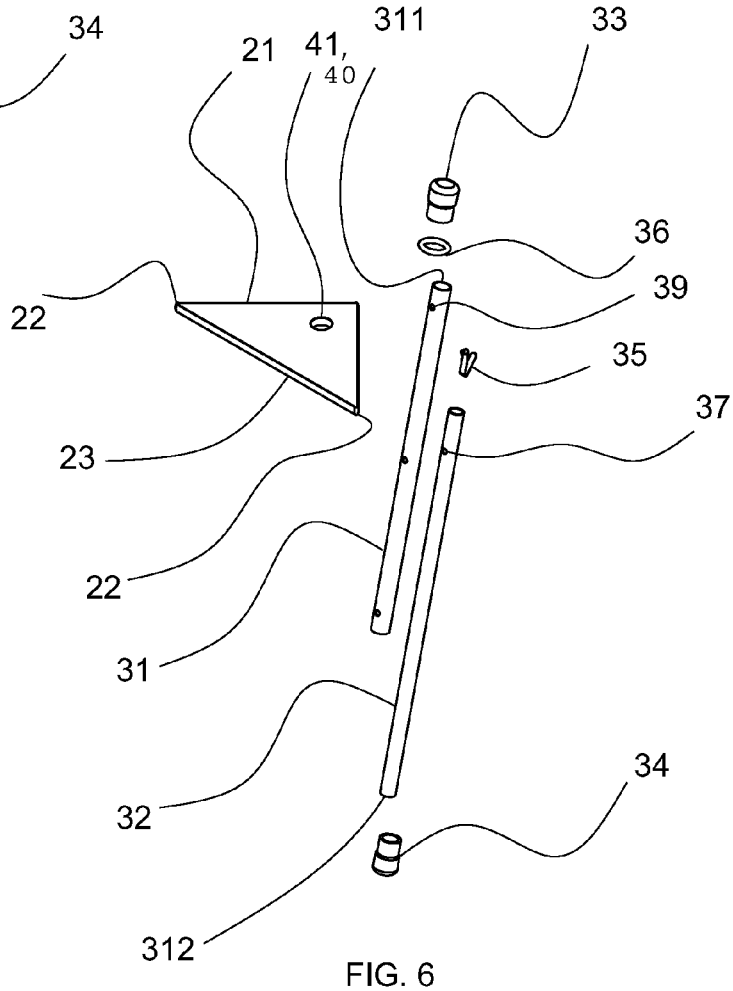
FIG. 6 is an exploded view of the embodiment.
Figure 7:
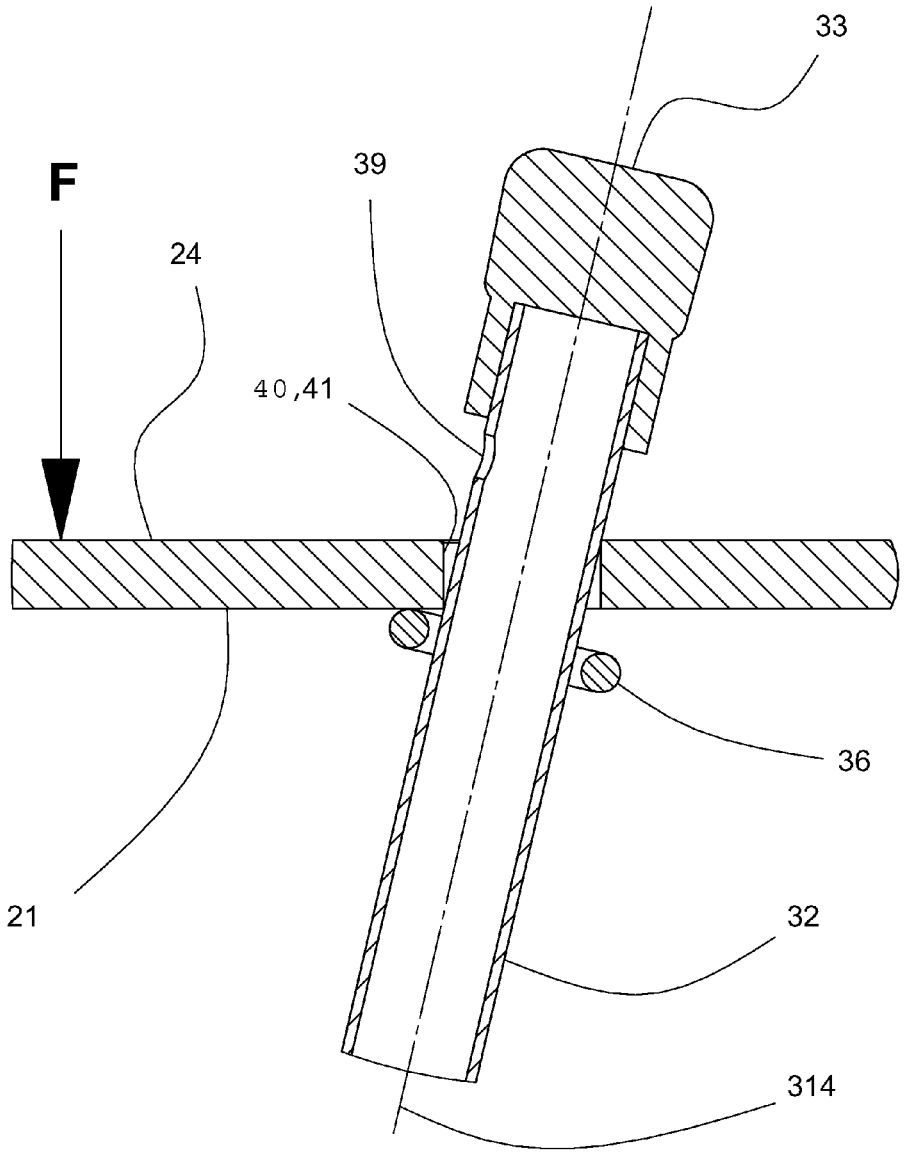
FIG. 7 is a side section view of a shelf with a clearance hole post connector.

As shown in FIGS. 5 and 6, the shelf 21 can have a substantially planar upper surface 24. The shelf 21 can have pockets, cavities, protuberances and various features for holding and positioning items.

The shelf 21 can have two outward facing contact sites, such as the contact site 22. The contact sites 22 can be positioned at distal edges of the shelf 21 and can be substantially perpendicular to the upper surface 25. In use, with the foot prop 10 positioned between the vertical walls 82, each contact site 22 can contact one of the vertical walls 82 to limit prop movement towards each vertical wall.

The shelf 21 can comprise a load-bearing edge 23. The load-bearing edge 23 can extend between the two contact sites 22. The load-bearing edge can be straight, can be angled, and can be curvilinear. The load-bearing edge can extend continuously between the contact sites. Alternatively, the load-bearing edge can be discontinuous. Alternatively, the load-bearing edge can have a plurality of load-bearing edge components. The load-bearing edge 23 can be distal and substantially opposite the intersection 83 when shelf is in use. A user can rest the foot 91 on the load-bearing edge 23 to utilize the foot prop 10.

Figure 8:
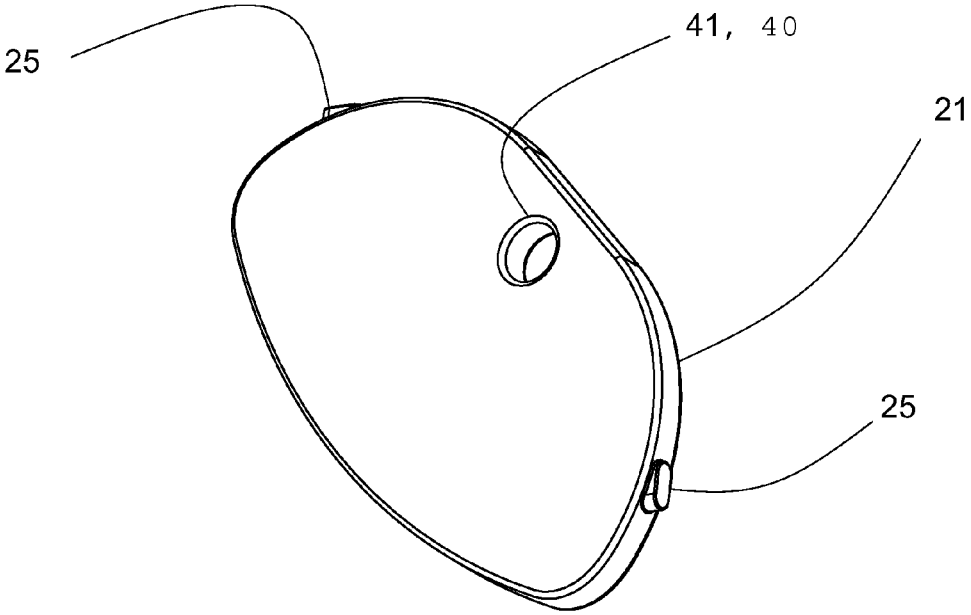
FIG. 8 is a perspective view of an embodiment of a shelf.
Figure 9:
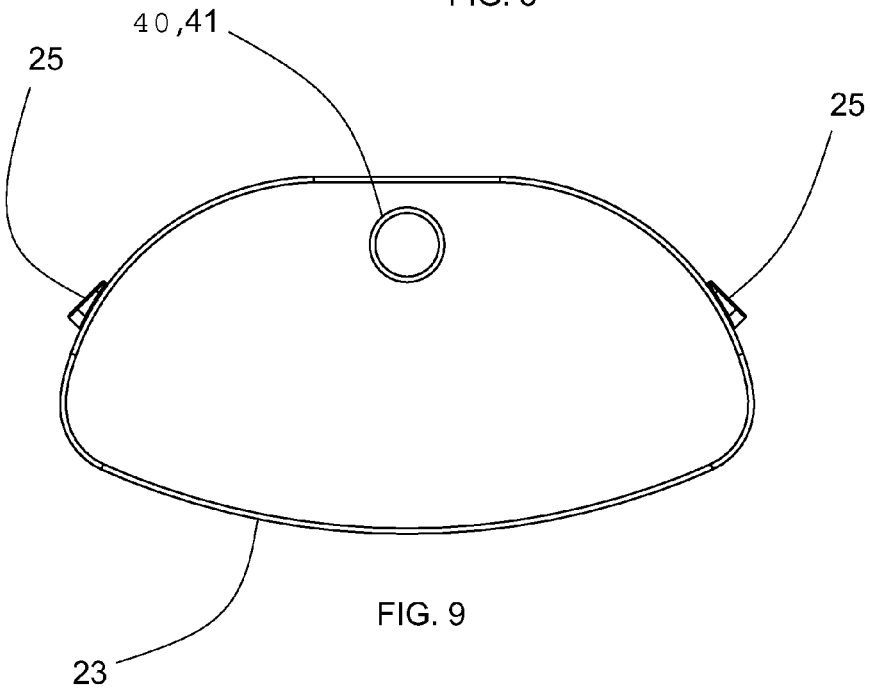
FIG. 9 is a top view of the embodiment of the shelf.

The shelf can have various shapes and sizes. The shelf can be substantially triangular, such as a right-triangular shape shown in FIG. 1 with equal legs of the triangle being contact sites 22 and the hypotenuse of the triangle being the load-bearing edge 23. Alternatively, the shelf can be curvilinear, as shown in FIGS. 8 and 9. Alternatively, the shelf can combine linear and curvilinear shapes.

The contact sites can comprise linear edges along the shelf, for example the contact sites 22. Alternatively, the contact sites can be discrete pads positioned along the shelf, such as the discrete pads 25 shown in FIGS. 8 and 9. The contact sites can be faced with secondary material having specific material properties such as coefficient of friction, durometer, surface finish, and various physical and material characteristics.

The foot prop 10 can comprise a post 30. The post 30, in use, can extend away from the shelf 21 opposite the upper surface 24. The post can pass through the shelf and extend away from the shelf in two directions. The post 30 can be connected to the shelf 21 via a load-activated post connector.

The load-activated post connector can operatively connect the shelf 21 to the post 30 so that the shelf 21 is spaced apart from the floor 81. The load-activated post connector can have a loose-fit mode and can have a gripping mode. In the loose-fit mode, the load-activated post connector can slide easily along the post to allow the shelf to be positioned at different heights from the floor 81. In the gripping mode, the load-activated post connector can resist shelf movement along the post so that the shelf can support an applied load, such as the foot 91, at a desired height from the floor 81. The load-activated post connector can switch from the loose-fit mode to the gripping mode when the load is applied to the load-bearing edge 23 of the shelf 21.

The foot prop 10 has a load-activated post connector 40 comprising an overlarge clearance hole defined by a circumferential surface 41 through the shelf 21. The circumferential surface 41 is sized to enable the post 30 to slide loosely through the shelf 21. "Circumferential surface" as used here and throughout this application, refers to the inner surface of the clearance hole and is not indicative of the shape of the clearance hole. The clearance hole can be round, rectangular, irregular, and a combination thereof and "circumferential surface" will apply equally to the inner surface of all shapes.

As shown in FIGS. 3-7, the post connector 40 can switch from the loose-fitting mode to the gripping mode when a downward force F is applied to the load-bearing edge 23. The downward force F on the load-bearing edge 23 can cause the shelf 21 to rotate about the post 30. As the shelf 21 rotates, the opposite sides of the circumferential surface 41 contact the post 30 and grip the post 30 to prevent the shelf 21 slipping downwards along the post 30. The post connector 40 can grip more tightly with increasing downward force, and facilitate increasing foot prop stability with increasing downward force.

The post 30, when the foot prop 10 is in use, can extend to and rest upon a floor 81. The post 30 can extend at a post angle 38 with respect to the upper surface 24. The post angle 38 can be an acute angle.

The post can be height-wise adjustable. As shown in FIGS. 5 and 6, the post 30 comprises an outer section 31, an inner section 32, and a lock 35. The outer section 31 and the inner section 32 can assemble telescopically to provide post length adjustment. The inner section 31 has a lock seat 37. The outer section 32 has a plurality of lock apertures 39 where each lock aperture 39 is configured to enable the lock 35 to extend through the inner section 32 outwards through the lock seat 37 and through a lock aperture 39. Aligning the lock seat 37 with each of the lock apertures 39 adjusts the post 30 height-wise.

As shown in FIGS. 1-4, a user can place the foot prop 10 proximal to the intersection 83 with the contact sites 22 contacting the walls 82. In use proximal to the intersection 83, the post can rest on the floor 81 with the post 30 making the post angle 38 with the shelf 21. In use, the user can rest the foot 91 on the load-bearing edge 23 and apply the downward force F to the shelf 21.

As shown in FIGS. 3-7, the relative positions of the load-bearing edge 23, the post connector 40, and the post 30 where the post 30 contacts the floor 81, causes a stabilizing wedge action when the foot applies downward force F to the foot prop. The post 30, via the post angle 38 and where the post 30 contacts the floor 81, can react to the force F by pushing the shelf 21 against the walls 82 while supporting the shelf 21 spaced-apart from the floor 81. When the load-bearing edge 23 is positioned medial the intersection 83 and where the post 30 contacts the floor 81, the force F on the load-bearing edge 23 can push the shelf 21 only towards the walls 82, not away, so that stability increases when the force F is applied.

The post can have various features, components, and combinations thereof, which provide height-wise adjustability. For example, the post can have a cam-type connection between the outer section and the inner sections. Counter-rotating the outer section with respect to the inner section can actuate the cam-type connection and positionally fix the sections via friction. Similarly, the cam-type connection can utilize a separate collar to actuate the cam-type connection.

Alternatively, the post can have a threaded compression-type connection, wherein a cone-shaped component is moved by rotation to cause the inner section to expand and contact the outer section.

Alternatively, the outer section and the inner section can be threadedly engaged to each other, so that counter-rotating the sections causes the height-wise adjustment.

Alternatively, the post can adjust height-wise via various other connection types known to those familiar with the art of connecting telescoping sections.

Alternatively, the post can be non-height-wise adjustable, and height adjustments can be achieved via other means and methods, such as by moving the shelf along the pole.

As shown in FIGS. 3-7, the post 30 can comprise a cap 33 and a tip 34 where the cap 33 and the tip 34 are positioned at a post top end 311 and a post bottom end 312, respectively. The cap 33 and the tip 34 can capture the shelf 21 on the post 30. The tip 34 can comprise non-marring and non-skid material, can be pointed and blunt, and can comprise various other shapes and materials.

The post 30 can further comprise shelf-positioning component. The shelf-positioning component can limit shelf movement along the post when the post connector is in the loose-fit mode. For example, the foot prop is easily portable and can be transported by hand from place to place. During transport there is typically no applied force acting on the shelf, so the post connector can enable the shelf to slide along the post. The shelf-positioning component can limit shelf movement to a particular region along the post during transport. Furthermore, the shelf-positioning component can provide height-adjustment when positioned along the post.

As shown in FIGS. 3-7, the shelf-positioning component can comprise an O-ring 36, where the O-ring 36 grips the post 30 proximal the cap 33. The O-ring can slide along the post 30 to provide desired positioning. The O-ring 36 can be useful for situating the shelf 21 proximal the post top end 311. The O-ring 36 can capture the shelf 21 between the O-ring 36 and the cap to prevent the shelf 21 from slipping down the post 30.

When the O-Ring 36 used with a post that is not height-wise adjustable, the O-ring 36 can provide height-wise adjustability for the shelf 21. Even when used with a height-wise adjustable post, the O-ring 36 can provide fine height-wise adjustability.

The foot prop 10 can comprise various other features, components, and combinations thereof, which prevent the shelf 21 from slipping down the post 30. Similarly, the foot prop 10 can comprise various features, components, and combinations thereof, that provide fine height-wise adjustability and provide height-wise adjustability when the post is not height-wise adjustable.

The invention claimed is:

1. A method of self-stabilizing using an adjustable foot prop while standing on one foot, the foot prop including a planar shelf penetrated throughout by an overlarge clearance hole, a post extending through the clearance hole, and a resilient ring fitting tightly around the post and limiting downwards shelf movement at an initial position along the post, the method comprising:

placing the adjustable foot prop at an intersection of two vertical surfaces with the shelf contacting the two vertical surfaces, the post extending upwards towards the intersection from a post bottom end resting on a base surface, and the shelf positioned at the initial position with a shelf bottom surface contacting the resilient ring;

rotating the shelf with respect to the post so that the clearance hole surrounds but does not contact the post while sliding the shelf along the post to a desired height from the base surface;

reverse-rotating the shelf with respect to the post so that the shelf grips the post at opposite sides of the clearance hole at the desired height from the base surface; and resting a raised foot on the shelf causing the shelf to further reverse-rotate and grip the post more tightly at the desired height from the base surface.

2. The method of claim 1, wherein the shelf reverse-rotates due to gravity prior to further reverse-rotating due to the raised foot.

3. The method of claim 1, wherein the shelf grips the post more tightly in direct proportion to an increasing load applied to the shelf by the raised foot.

4. The method of claim 1, wherein the clearance hole is positioned medial the intersection and a location at which the raised foot rests on the shelf.

5. The method of claim 1, wherein the shelf is slid along the post with one hand while the post is held in contact with the base surface by gravity alone.

6. A method of self-stabilizing using an adjustable foot prop while standing on one foot, the foot prop including a planar shelf penetrated throughout by an overlarge clearance hole, a post extending through the clearance hole and interacting with the shelf in either a loose-fit mode in which the clearance hole surrounds but does not contact the post, or a gripping mode in which the shelf contacts and grips the post at opposite edges of the clearance hole, and a resilient ring fitting tightly around the post and limiting downwards shelf movement at an initial position along the post, the method comprising:

placing the adjustable foot prop at an intersection of two vertical surfaces with the shelf contacting the two vertical surfaces and the post extending upwards towards the intersection from a post bottom end resting on a base surface, the shelf positioned at the initial position with a shelf bottom surface contacting the resilient ring;

rotating the shelf until the post interacts with the shelf in the loose-fit mode;

sliding the shelf, in the loose-fit mode, upwards along the post to a desired height from the base surface;

reverse-rotating the shelf into the gripping mode to grip the post at the desired height; and resting, with the shelf in the gripping mode, a raised foot on the shelf and causing the shelf to press against the two vertical surfaces and further reverse-rotate to grip the post more tightly at the desired height.

7. The method of claim 6, wherein the shelf and the post form a post angle, the post angle in the gripping mode being different than the post angle in the loose-fit mode.

8. The method of claim 7, wherein the post angle in the gripping mode is an acute angle and the post angle in the loose-fit mode is a non-acute angle.

9. The method of claim 6, wherein, upon releasing the shelf, the shelf reverse-rotates due to gravity prior to further reverse-rotating due to the raised foot.

10. The method of claim 6, wherein the shelf grips the post more tightly in direct proportion to an increasing load applied to the shelf by the raised foot.

11. The method of claim 6, wherein the shelf is slid along the post with one hand while the post is held in contact with the base surface by gravity alone.

* * * * *